US005816172A

United States Patent [19]

Carter

[11] Patent Number: 5,816,172

[45] Date of Patent: Oct. 6, 1998

[54] PAPERBOARD PALLET

[75] Inventor: Leewood C. Carter, Englewood, Fla.

[73] Assignee: Reusable Rolls, Inc., Ooltewah, Tenn.

[21] Appl. No.: 954,790

[22] Filed: Oct. 21, 1997

[51] Int. Cl.[6] ..... B65D 19/00

[52] U.S. Cl. ..... 108/51.3; 108/56.1

[58] Field of Search ..... 108/51.3, 56.1, 108/56.3, 57.17, 57.18, 57.19, 57.33; 52/660, 664, 669; 403/398, 399, 400

[56] References Cited

U.S. PATENT DOCUMENTS

| | | | |
|---|---|---|---|
| 3,176,632 | 4/1965 | Yingling | 108/56.1 X |
| 3,256,839 | 6/1966 | Peterson et al. | 108/56.1 |
| 3,654,877 | 4/1972 | Barrett | 108/56.1 |
| 3,755,988 | 9/1973 | Van der Sluys | 52/664 X |
| 5,067,418 | 11/1991 | Carter | 108/56.1 X |
| 5,272,990 | 12/1993 | Carter | 108/51.3 |
| 5,636,577 | 6/1997 | Gow | 108/57.17 |

FOREIGN PATENT DOCUMENTS

| | | | |
|---|---|---|---|
| 6609937 | 1/1967 | Netherlands | 52/669 |

*Primary Examiner*—Jose V. Chen
*Assistant Examiner*—Janet M. Wilkens
*Attorney, Agent, or Firm*—Miller & Martin LLP; Alan Ruderman, Esq.

[57] ABSTRACT

A pallet constructed from paperboard has longitudinally extending runners formed from paperboard cylindrical cores and connected to a deck formed from a number of elongated arcuate segments of cylindrical paperboard cores. The deck members have arcuate slots extending transverse to the direction of elongation, the slots being of a configuration conforming to the cylindrical configuration of the exterior of the runners. Each deck member is positioned on each of the runners with the runners received within the slots and is secured thereto by a fastener. The uppermost portion of the deck members lie in a common plane. The runners remote from the deck members have a pair of transversely extending grooves and have slats secured adjacent the grooves extending across all of the cores to form a base.

2 Claims, 1 Drawing Sheet

PAPERBOARD PALLET

BACKGROUND OF THE INVENTION

This invention relates to pallets constructed from paperboard, and more particularly to pallets constructed from cylindrical paperboard cores or tubes.

As discussed in Carter U.S. Pat. No. 5,067,418, assigned to the common assignee of the instant application, large amounts of thick walled paperboard or fiber cores or tubes are used by various industries. Paper, paperboard, carpet, cloth and plastics are wound about such cores and, after removal of these products from the cores, the cores must be disposed of.

Cores of this type can vary in length and generally have a four inch, five inch or six inch outside diameter with a wall thickness of at least 0.3 inch with a range up to 0.750 inch. The problems involved in disposing of heavy wall cores or tubes was pointed out and discussed in my aforesaid patent and an ecological solution to the disposal of spent cores was provided by a pallet constructed from such paperboard cores forming longitudinally extending runners and having a deck formed from a number of elongated arcuate segments of cylindrical paperboard cores in accordance with the disclosure and teachings thereof. In that patent, the arcuate deck segments are positioned within aligned dovetail notches in the runners. Other notches in the bottom of the runners received arcuate segments of cores to form lower brace members. Although pallets constructed in this manner have proved to be commercially successful, the success may be somewhat limited by the manufacturing process. Thus, it is highly desirable to reduce the manufacturing costs associated with the production of pallets according to the teachings of that patent.

SUMMARY OF THE INVENTION

Consequently, it is a primary object of the present invention to provide a rigid load supporting pallet constructed and assembled from paperboard cores or tubes of circular cross sectional configuration which are relatively inexpensive to manufacture.

It is another object of the present invention to provide a pallet having a plurality of runners constructed from paperboard or fiber cores or tubes having a deck formed from and interconnected together by cross members constructed from segments of paperboard or fiber cores or tubes, the segments being formed with arcuate grooves for receiving runners.

Accordingly, the present invention provides an improvement to the pallets disclosed in my aforesaid patent and in my U.S. Pat. No. 5,272,990, and in addition U.S. Pat. No. 3,256,839 and 3,654,877, by voiding the need to connect the deck members to the runners by cutting notches in the runners, but rather cuts runner receiving grooves in the deck segments. These runner receiving grooves have an arcuate configuration conforming substantially to a small portion of the periphery of the runners so that the upper surfaces of the segments have an apex lying in a common plane. Thus, the cores forming the runners need not be notched except to provide large rectangular lifting fork tine receiving recesses, if desired, the recesses being separated by slats.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Preferring now to the drawings, a pallet generally designated at 10 is illustrated which incorporates structure constructed in accordance with the principles of the present invention. The pallet comprises a plurality of longitudinally extending runners 12, 14, 16, constructed from hollow thick walled paperboard cores. Cores of this type are generally available as hollow cylindrical members varying in length and generally have a four inch, five inch or six inch outside diameter. The most readily available cores are of the four inch diameter size and most pallets utilize runners of this size, although other sizes may be utilized. Cores of this type are typically used as a disposable mandrel about which paper, lingerboard, carpet or the like are wound in a roll and remain with the primary product until the roll is exhausted. These paperboard cores have a wall thickness varying from approximately 0.3 inch to approximately 0.750 inch and are known as thick walled cores. Since they do not readily break down in a pulper and are therefore not desirable for recycling at paperboard mills, it may be utilized for the manufacture of paperboard pallets in accordance with the present invention.

Figure 1:
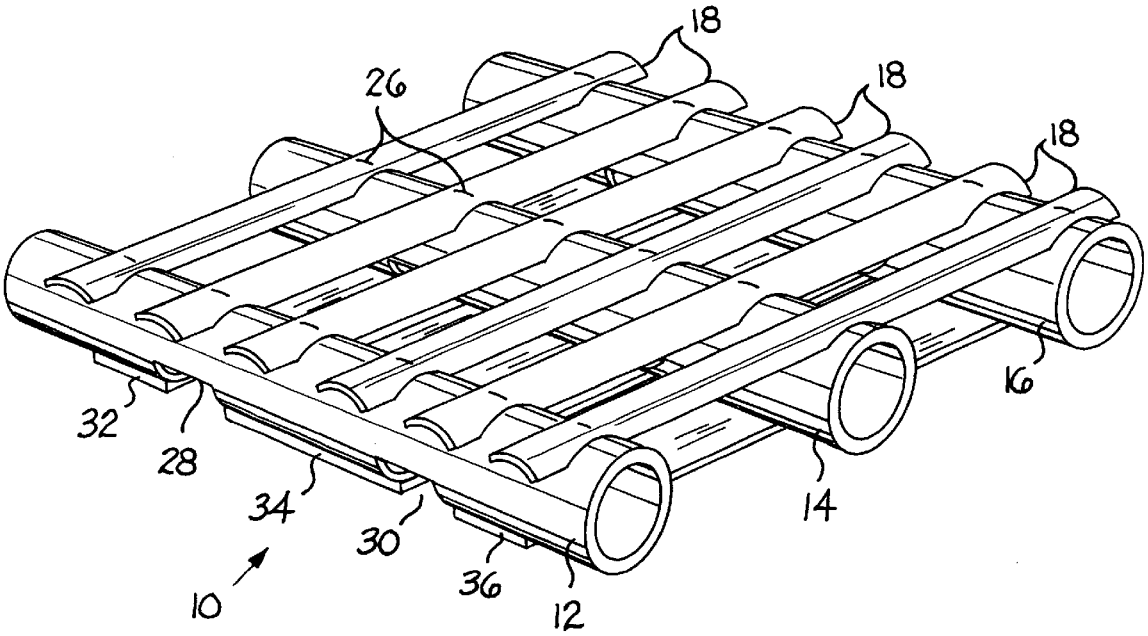
FIG. 1 is a perspective view of the preferred form of a pallet constructed in accordance with the principles of the present invention.
Figure 2:
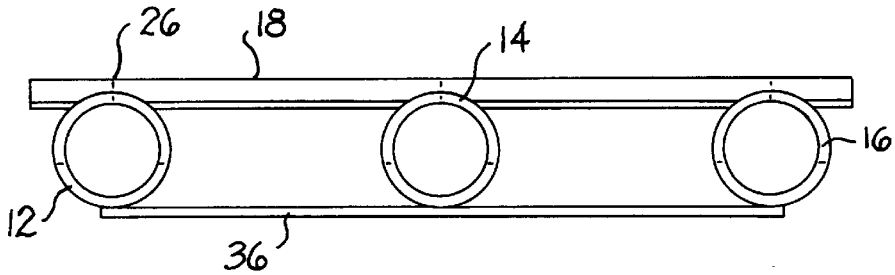
FIG. 2 is an end elevational view of the pallet illustrated ill FIG. 1.
Figure 3:
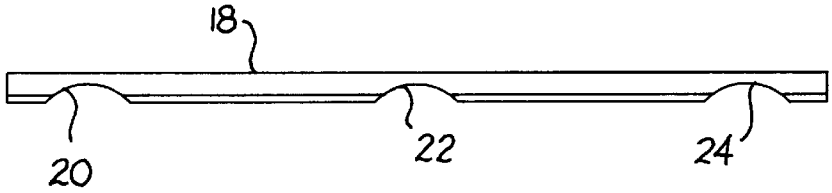
FIG. 3 is a elevational view of one of the deck forming members of the pallet.

As best illustrated in FIG. 3, the runners of the present invention do not include the notches at longitudinally spaced locations extending transversely as in my aforesaid U.S. Pat. No. 5,067,418. Instead, cross members 18 formed from longitudinally extending segments of other cylindrical cores, as described in the aforesaid patent, forming the deck of the pallet and being designated as deck members, include spaced apart arcuate slots 20, 22, 24, the slots having a radius substantially equal to that of the runners 12, 14, 16, with which they are used to form the pallet. The spacing between the respective slots 20, 22, 24 is equal to the desired spacing between the runners 12, 14, 16. Since the slots have a configuration conforming to the contour of the runners, the apex of the upper surface of the deck members are substantially planar with each other and thus a flat deck surface is provided, i.e., although the deck members 18 have an arcuate configuration, the surface of the deck members most remote from the runners substantially lie in a common plane. Additionally, because of the arcuate contour of the slots 20, 22, 24, a substantially large contact surface is provided between the deck members and the runners. This provides a relatively large contact surface for the application of glue, if desired. At any rate, staples, nails or other fastening members 26 may be used to secure the deck members to each of the runners. Although any number of runners and deck members may be utilized, it is expected that three such runners will typically be used with a sufficient number of deck members to support the varying loads to be carried by the pallet. Typically, it is expected that three five foot long runners will be used with six or seven deck members.

At the surface of the runners 12, 14, 16, most remote from the deck members 18, the runners may be provided with a pair of spaced apart substantially rectangular grooves 28, 30 for permitting four-way entry by the tines of a fork lift or the like. Thus, not only may a fork lift enter between and substantially parallel to the runners, but if the pallet is not positioned for such entry, the tines may enter the slots 28, 30 to lift the runners and thus the entire pallet. In certain cases, this may even be the preferred mode of lifting the pallet since it minimizes the separating force between the runners and the deck members. Fastened to the runners on each side of the groove 28 and each side of the groove 30 is a respective slat 32, 34, 36, the slat 34 being disposed intermediate the grooves 28, 30 and thus, because of the conventional spacing between the tines of a fork lift, it is wider than the slats 32 and 36. The slats 32, 34, 36, which are also formed from paperboard, form a lower brace and also a floor engaging space for the pallet. The slats 32, 34, 36 may be bonded by glue or the like to the runners and, if desired, may be further secured to the runners by staples, nails or the like (not illustrated).

The runners 12, 14, 16 are formed by first cutting the starting core material to length and the slots 28, 30 are cut by saw blades or other conventional means. The deck members 18 are formed from segments of other cores. They are cut to length and thereafter passed through apparatus having cutting heads for forming the arcuate slots or cutouts. The cutting heads, which may be circular in configuration having a periphery substantially equal to the shape of the slots 20, 22, 24, may be mounted on a horizontally disposed rotatable shaft, or alternatively the cutters may be router type cutters mounted on a vertical shaft. Once the deck members are formed, they may be positioned on the respective runner 12, 14, 16 in spaced apart relationship and secured by the fastening means 26. The slats 32, 34, 36 may thereafter be secured to the runners between the slots 28 and 30.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A pallet having a load supporting deck and a plurality of spaced apart longitudinally elongated runners, each runner being formed from a hollow cylindrical paperboard core, said deck including a plurality of spaced apart deck members, which extend transversely to the runners, each deck member comprising an elongated arcuate segment of a hollow cylindrical paperboard core, a plurality of slots formed in said deck members extending transverse to the direction of elongation of the deck members, each slot having an arcuate configuration conforming to the cylindrical configuration of the exterior of the runners such that a surface portion of each runner may be received within one of the slots, said slots being spaced apart by an equal amount, a fastening member for securing each deck member to all the runners with each runner being disposed within one of the slots of each deck member and a base secured to the runners at a disposition opposite to said deck members.

2. A pallet as recited in claim 1, wherein said runners have a pair of spaced apart grooves extending transversely therethrough at a disposition remote from said deck members, and said base comprising slats secured to said runners and extending transversely thereto adjacent to each groove.

* * * * *